United States Patent [19]

Bakermans

[11] 4,005,516

[45] Feb. 1, 1977

[54] HAND TOOL HAVING DOUBLE TOGGLE LINKAGE

[75] Inventor: Johannes Cornelis Wilhelmus Bakermans, Harrisburg, Pa.

[73] Assignee: AMP Incorporated, Harrisburg, Pa.

[22] Filed: Mar. 15, 1976

[21] Appl. No.: 666,553

[52] U.S. Cl. ..... 29/749; 29/750; 29/751; 81/363; 81/373

[51] Int. Cl.[2] ..... H01R 43/04

[58] Field of Search ..... 29/203 H, 203 D, 203 DT, 29/203 MW, 203 P, 203 J, 203 HC; 100/286; 72/451; 81/355, 356, 357, 362, 363, 373

[56] References Cited

UNITED STATES PATENTS

| | | | |
|---|---|---|---|
| 3,492,854 | 2/1970 | Eppler | 81/363 X |
| 3,630,068 | 12/1971 | Floyd, Jr. | 29/203 H |

*Primary Examiner*—Carl E. Hall

*Attorney, Agent, or Firm*—Frederick W. Raring; Robert W. Pitts; Jay L. Seitchik

[57] ABSTRACT

Plier-type hand tool comprises a frame having spaced-apart jaws and a fixed handle extending therefrom. One of the fixed jaws has a ram therein which is reciprocable towards and away from the other jaw. The actuating means for moving the ram comprises a movable handle which is pivoted to the frame. Closing of the handles causes two toggle mechanisms to be straightened which are concatenated with the ram. The arrangement of the toggle mechanisms is such that a relatively deep throat is provided between the jaws for the acceptance of a wide workpiece such as a flat electrical cable. A removable tension member may be provided on the ends of the jaws to prevent excessive flexure of the jaws during use of the tool.

11 Claims, 7 Drawing Figures

HAND TOOL HAVING DOUBLE TOGGLE LINKAGE

BACKGROUND OF THE INVENTION

This invention relates to plier-type hand tools having a double toggle actuating linkage. The disclosed embodiment is particularly directed to the achievement of a tool for installing a multi-contact electrical connector on a flat conductor cable although other uses for the invention will be apparent from the following description. Tools having toggle mechanisms are shown, for example, in U.S. Pat. Nos. 2,327,368; 2,436,497; 2,464,472 and 1,362,595.

U.S. Pat. No. 3,820,055 discloses and claims a multi-contact electrical connector which is installed on a flat conductor cable by simply locating the cable adjacent to a cable-receiving surface of the connector housing and moving the cable normally of its plane towards that surface. Contact terminals extend from the cable-receiving surface and these terminals penetrate the cable and establish electrical contact with the conductors upon such movement of the cable.

Connectors of the type shown in U.S. Pat. No. 3,820,055 are now being manufactured with 50 and more contact terminals extending from the cable-receiving surface for engagement with the 50 conductors of the cable. When this number of conductors and terminals is involved, a relatively high force is required to install the connector on the cable and the installation process must be carried out with a high degree of precision and control if a satisfactory installation is to result. While there are a vast number of plier-type hand tools commercially available, and many more have been proposed in prior publications, such as the U.S. Patents cited above, there is apparently no suitable hand tool for connector installing operations of the type under consideration. In general, most hand tools are designed such that they are incapable of accommodating a relatively wide (3 inches or more) cable between their jaws. Furthermore, most types of hand tools, if modified for connector-cable installation processes, would tend to undergo elastic deflection when the connector is installed on the cable because of the high stresses developed and the deflection, in turn, would result in non-uniform application of forces on the cable and connector which would, in turn, lead to unsatisfactory installation.

I have developed a plier-type hand tool having parallel jaws and a reciprocable ram in one of the jaws which is movable towards the outer jaw. The ram is reciprocated by a removable handle which, upon movement thereof, straightens two toggle mechanisms to drive the ram along its working stroke. The arrangement of the toggle mechanisms is such that a high thrust or force is developed in the ram, a thrust which is more than adequate to install a relatively high count flat cable on a connector. The toggle arrangement is also such that a deep throat is provided in the tool and a relatively wide flat cable can be accommodated between the jaws of the tool. Finally, a removable tension member extends between the ends of the jaws so that excessive deflection of the tool (as a result of high localized stresses) is avoided.

It is accordingly an object of the invention to provide an improved plier-type hand tool. A further object is to provide a hand tool capable of being used on a relatively large workpiece such as a relatively wide multi-conductor cable. A further object is to provide a hand tool which is not subject to excessive elastic deflection when put to use. A further object is to provide plier-type hand tool which is convenient to use by a person of average strength and which is capable of developing a high force or thrust.

These and other objects of the invention are achieved in a preferred embodiment thereof which is briefly described in the foregoing abstract, which is described in detail below, and which is shown in the accompanying drawing in which.

Figure 3:
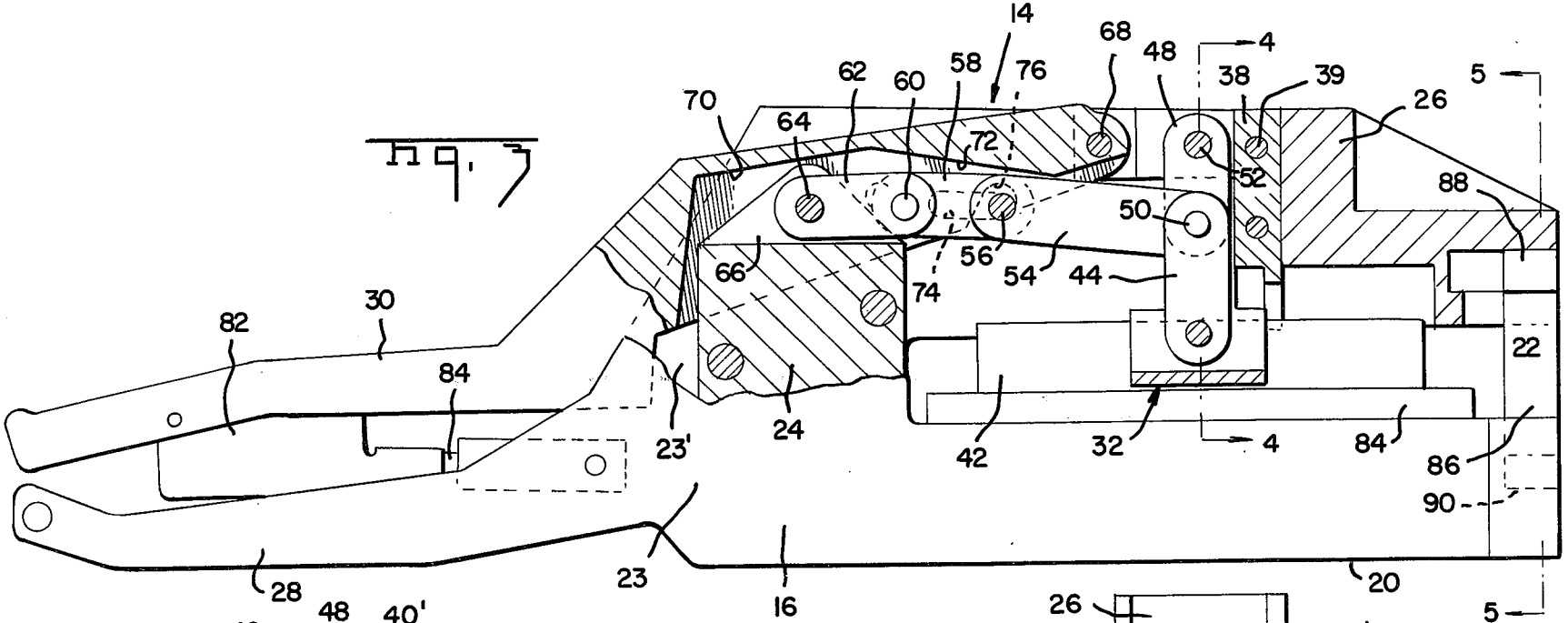
FIG. 3 is a view similar to FIG. 1 but showing the positions of the parts when the ram is in its bottom dead center position.
Figure 5:
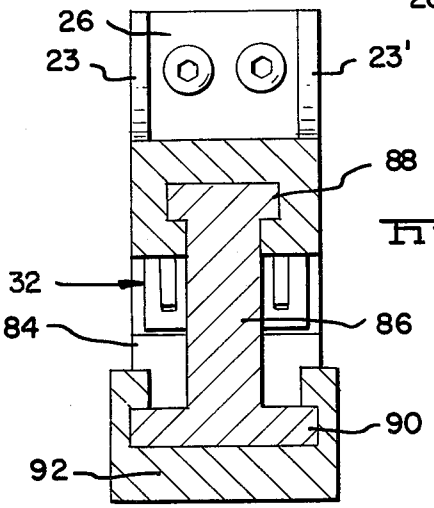
Figure 4:
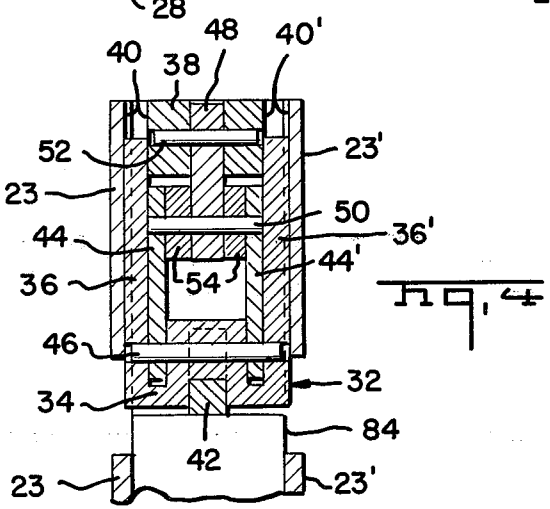

FIGS. 4 and 5 are views taken along the lines 3—3 and 4—4 of FIG. 3.

Figure 1:
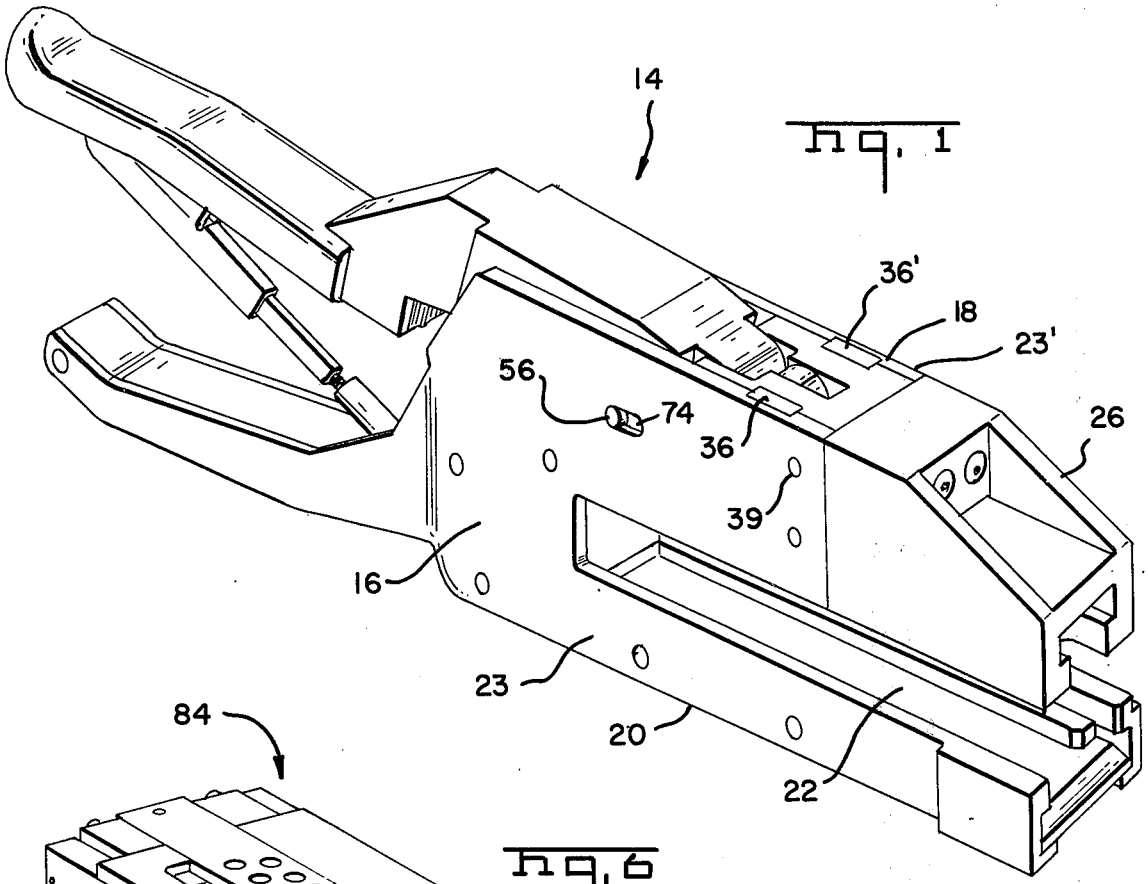
FIG. 1 is a perspective view of a preferred form of tool in accordance with the invention.
Figure 6:
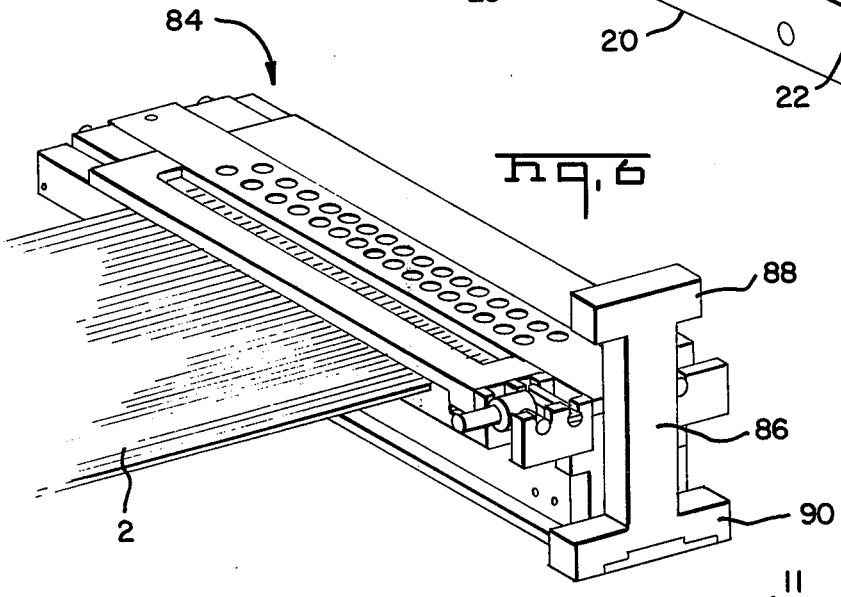

FIG. 6 is a perspective view of a fixture having an integral tension member which forms part of the invention.

Figure 7:
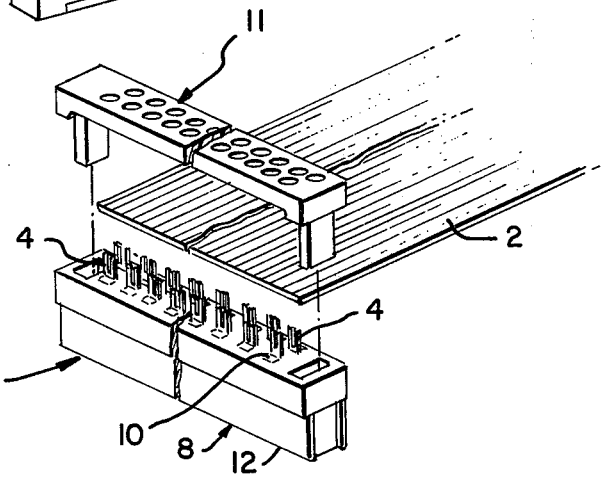

FIG. 7 is an exploded view of a multi-contact electrical connector and a flat conductor cable to which the connector is attached.

The herein disclosed embodiment of the invention is intended to install a connector 6 (FIG. 7) on a flat conductor cable 2 of the type having a plurality of parallel side-by-side conductors. The connector 6 may be of the general type disclosed and claimed in U.S. Pat. No. 3,820,055 and has a generally prismatic housing 8 which has a cable receiving face 10 and a face 12 on the opposite side thereof from the cable receiving face. A plurality of contact terminals 4 extend normally from the face 10 and these terminals are connected to the individual conductors in the cable by merely moving the cable relatively towards the face 10 so that the terminals penetrate the cable and establish electrical contact with the conductors in the cable. Advantageously, a cover member 11 is provided which is latched to the housing and which covers the ends of the terminals after the connector has been installed on the cable. Connectors of this type may have a relatively large number of terminals when they are intended for cables having the large numbers of conductors therein. When the connector is of a relatively small size (e.g. having five or ten terminals), as shown in U.S. Pat. No. 3,820,055, it is a simple matter to install the connector on the cable but the installation of a connector having say 50 terminals on a cable having the same number of conductors requires a relatively high force and conventional and relatively simple tools are not suitable for the operation.

A tool 14 in accordance with the invention comprises a frame having a yoke portion 16 and a pair of parallel fixed jaws 18, 20 extending from the yoke portion. The opposed surfaces of the jaws are spaced apart to provide a gap 22 and this gap extends inwardly for a substantial distance to the yoke 16 so that a relatively wide cable can be accommodated between the jaws. The tool frame may be comprised of spaced-apart stamped plates 23, 23' (FIG. 4) and suitable spacer means as shown at 24, may be provided between the plates and secured to the plates by fasteners as shown. Alternatively, the tool frame can be of cast and machined parts if desired. The upper jaw 18 has a solid block 26 on its free end and the lower arm 20 has an enlarged end for reasons discussed below.

A fixed handle 28 extends from the yoke 16 in substantial alignment with the jaw 20. A movable handle 30 is normally spaced from the fixed handle and pivoted to the tool as also described below. A reciprocable ram 32 is slidably contained in the first jaw 18, this ram being generally U-shaped as shown in FIG. 4 and having a web portion 34 and sidewalls 36, 36'. The sidewalls are slidably received in guideways 40 provided in the inner surfaces of each of the plates 23, 23' and the outwardly facing surfaces of a bearing block 38 which is secured between the plates 23, 23' by fasteners 39. The base portion 34 and the sidewalls 36, 36' of the rams can be separate parts, if desired, since they are held together by a pivot pin 46 which is described below.

The ram 32 has an elongated pressure bar 42 secured thereto which extends in the direction of the jaws 18, 20. This pressure bar is advantageously dimensioned to apply a uniform force to the surface of a suitable fixture which is used to press the cable and the connector against each other. A specific form of fixture for installing the connector on the cable is shown in my co-pending application Ser. No. 666,552, although other types of fixtures can be used if desired.

The ram 32 is reciprocated by first and second toggle mechanisms, the first toggle mechanism comprising a pair of parallel links 44, 44' which are pivotally connected at their lower ends, as viewed in FIG. 4, to the portion 34 of the ram by a pin 46. The upper ends of the links 44, 44' are pivotally connected by pin 50 to a single link 48 which is, in turn, pivotally connected by a pin 52 to the bearing block 38. A pair of parallel straightening links 54 are pivotally connected to the pin 50 on each side of the upper toggle link 48 and these straightening links extend leftwardly, as viewed in FIG. 2, to the second toggle mechanism. This second toggle mechanism comprises a link 58 which is connected at one end to the pin 56 and to a knee joint pivot pin 60 at its other end. Parallel links 62 are also connected to pin 60 and have their other ends pivoted to a fixed pivot 64 on an ear 66 which is integral with the spacer block 24.

Figure 2:
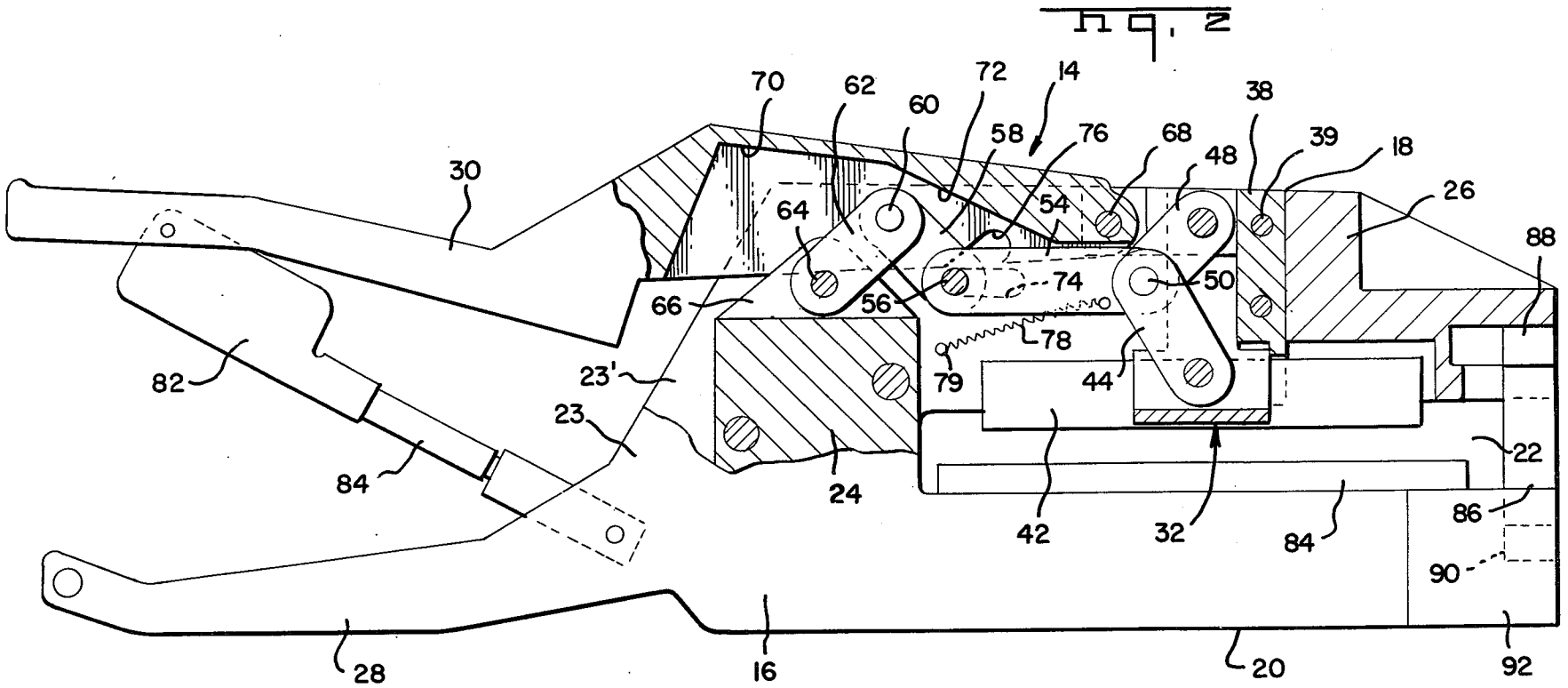
FIG. 2 is a side view, partly in section, of a preferred embodiment of the invention, this view showing the positions of the parts when the ram is in its raised or retracted position.

The movable handle 30 is pivoted to the bearing block 38 by a pivot pin 68 which is disposed adjacent to the first toggle mechanisms so that the movable handle extends leftwardly in FIG. 2 beside and past, the straightening links 64 and past the second toggle mechanism. Movable handle 30 is internally recessed as shown at 70 and has an inclined surface 72 which receives the knee joint of the second toggle mechanism when the handle is closed from the position of FIG. 2 to the position of FIG. 3. The ends of the knee joint pin 60 extend into slightly elongated slots 75 in the handle so that the second toggle will be straightened when handle 30 is swung towards handle 28. Guidance slots 74 are provided in the side plates 23, 23' and receive the ends of the pivot pin 56 of the second toggle mechanism so that when the handle is closed, this second toggle mechanism is forced to straighten itself and drive the connecting link 54 rightwardly. It should also be noted that a notch 76 is provided in the handle 30 to provide clearance for the ends of the pivot pin 56 as will be apparent from FIG. 2 and 3. The first toggle comprising the link means 44, 44' and the link 48 is normally maintained in a broken condition by a spring 78 which is secured at one end to the straightening link 54 and which is secured at its other end to a pin 79. This spring biases the link 54 leftwardly thereby maintaining both toggle mechanisms in a broken condition.

A full stroke compelling mechanism is provided, as is common practice on tools for crimping or otherwise compressing electrical connecting devices. This full stroke compelling mechanism may comprise a rod 84 which has its end pivoted to the fixed handle 28 and which extends into a housing 82 which is pivoted to the handle 30. Ratchet teeth (not shown) are provided on the rod 84 and are engaged by a pawl in the housing 82, the arrangement being such that if the operator starts to close the handles, he must continue to do so until complete closure is achieved.

It is desirable to use a suitable fixture 84 when the connector is being installed on the cable, the fixture having means for holding the connector and cable in their proper positions relative to each other for installation. A preferred form of fixture is described in detail in application Ser. No. 666,552 and the fixture need not be described here.

In accordance with a preferred embodiment of the instant invention, a tension member 86 extends between the free ends of jaws 18, 20 and this tension member is integral with a base plate portion 87 of the fixture. As shown in FIG. 5, the tension member has laterally extended portions 88, 90 on its ends so that it can be slid into complementary recesses in the block 26 and in the end of jaw 20. This tension member prevents excessive flexure of the jaws when the tool is used so that the dimensional precision of the tool is maintained during use.

In use, the connector housing and the cable are positioned in the fixture 84 and the fixture is then slid into the tool and between the jaws until it is in the position of FIG. 2. Thereafter, the movable handle is squeezed towards the fixed end and the toggles are straightened to drive the ram downwardly and move the cable relatively against the cable receiving face of the connector.

An important structural feature of the invention is the U-shaped ram 32 which is driven downwardly upon straightening of the first toggle mechanism. The sidewalls 36, 36' of this ram provide an extensive bearing surface as is required for smooth operation without the development of unduly high stresses and for bearing loads. Also, the first toggle mechanism is contained in the ram (note that when the ram is in its raised position, bearing block 30 is between the sidewalls 36, 36') and bulkiness or excessive size in this portion of the tool is avoided.

While the herein disclosed embodiment is particularly intended for installing connectors on cables, it will be apparent that tools in accordance with the invention can be used for a variety of purposes.

What is claimed is:

1. A plier-type hand tool comprising:

a frame having first and second fixed jaws extending cantilever fashion therefrom and an integral handle extending therefrom, said integral handle being in alignment with said second jaw, said first and second jaws being separated by a gap for reception of a workpiece, a ram slidably mounted in said first jaw for movement towards and away from said second jaw, first and second toggle mechanisms, each of said toggle mechanisms comprising two links connected to each other at a knee joint, said first toggle mechanism being in said first jaw and being pivotally connected at one end thereof to said ram and at the other end thereof to said first jaw, said first toggle mechanism extending transversely of said first jaw when in a straightened condition, a straightening link, said straightening link being pivotally connected at one end thereof to said knee joint of said first toggle mechanism and extending from said knee joint towards said frame, said second toggle mechanism being pivotally connected at one end thereof to said straightening link and being pivotally connected to said frame at the other end thereof, said second toggle mechanism extending in the direction of said first jaw when in a straightened condition, a movable handle pivoted to said first jaw at a location proximate to said straightening link and extending from said first jaw past said second toggle mechanism, past said frame portion, and externally of said frame portion beside said integral handle, said knee joint of said second toggle being pivotally connected to said movable handle intermediate the ends thereof whereby upon movement of said movable handle towards said fixed handle when said first and second toggle mechanism are broken, said second toggle mechanism is straightened and said straightening link is driven towards said first toggle whereby said first toggle mechanism is straightened and said ram is moved towards said second jaw.

2. A plier-type hand tool comprising:

a frame comprising a yoke portion, first and second fixed jaws extending cantilever fashion from said yoke portion, and an integral handle extending from said yoke portion, said integral handle being in alignment with said second jaw, said first and second jaws being separated by a gap for reception of a workpiece, a ram slidably mounted in said first jaw for movement towards and away from said second jaw, a first toggle in said first jaw, said first toggle comprising first and second toggle links, said first link being pivoted at one end thereof to said ram, said second link being pivoted at one end thereof to said first jaw, said first and second links having their other ends pivoted to each other on a first toggle knee joint pivot pin, said first toggle being movable from a broken position to a straightened position and extending parallel to the direction of movement of said ram when in said straightened position, a straightening link, said straightening link being pivotally connected at one end to said first toggle knee joint pivot pin, said straightening link extending from said first toggle in the direction of said first jaw towards said yoke portion, a second toggle comprising first and second toggle links connected at a knee joint by a second toggle knee joint pivot pin, said second link of said second toggle being pivotally connected to said frame, said first link of said second toggle being pivotally connected to said straightening link, a movable handle pivotally connected to said first jaw at a location between said first toggle and said second toggle, said movable handle extending past said first jaw, through said yoke portion and externally of said yoke portion beside said integral handle, said knee joint of said second toggle being pivotally connected to said movable handle intermediate the ends thereof whereby, upon movement of said movable handle in a direction to straighten said second toggle, said straightening link is moved towards said first toggle whereby said first toggle is straightened and said ram is moved towards said second jaw.

3. A hand tool as set forth in claim 2, said tool having a removable tension member extending between the free end portions of said first and second jaws.

4. A hand tool as set forth in claim 2, said jaws extending parallel to each other, a work holding fixture slidably received in said second jaw and being removable from said second jaw upon movement of said fixture in the direction of said second jaw past the free end of said second jaw.

5. A hand tool as set forth in claim 4, said tool having a removable tension member extending from said end of said second jaw to the free end of said first jaw.

6. A hand tool as set forth in claim 5, said tension member being integral with said fixture.

7. An apparatus for installing a multi-contact electrical connector on a flat conductor-cable, said cable having a plurality of electrical conductors therein, said connector being of the type comprising an insulating housing having a cable-receiving surface and having a plurality of contact terminals extending from said surface whereby upon positioning said cable adjacent to said surface and pressing said cable and said housing together, said contact terminals penetrate said cable and establish electrical contact with said conductors, said apparatus comprising:

a head portion having first and second fixed jaws extending therefrom, said jaws having free ends and being spaced apart whereby a gap is provided between said jaws, said gap extending inwardly from said free ends, ram means in said first jaw, said ram means being reciprocable towards and away from said second jaw, actuating means for reciprocating said ram means, locating means for locating said cable and said connector in said gap with the axis of said cable extending transversely of said jaws and with said contact terminals in said connector in alignment with said conductors, and removable tension member means extending between said free ends of said jaws whereby, upon removal of said tension member means, a portion of said cable and said connector can be positioned in said gap and located by said locating means, and upon replacement of said tension members means and movement of said ram means towards said second jaw, said terminals will penetrate said cable and establish electrical contact with said conductors.

8. Apparatus as set forth in claim 7, said locating means for locating said connector comprising a connector fixture, said connector fixture being mounted in said second jaw.

9. Apparatus as set forth in claim 8, said fixture being removably mounted in said second jaw, said tension member means being secured to said fixture, said free end of said first jaw and said tension member means having interengaging portions when said fixture is in said second jaw.

10. Apparatus as set forth in claim 9, said apparatus comprising a hand tool, said actuating means comprising handle means concatenated with said ram means.

11. Apparatus as set forth in claim 9, said apparatus comprising a hand tool, said actuating means comprising first and second toggle means, said first toggle means being pivotally connected at its ends to said first jaw and said ram means, said second toggle means being pivotally connected at one end thereof to said head portion and being concatenated at the other end thereof to the knee joint of said first toggle means, a movable handle pivotally connected to said head portion, said second toggle means being pivotally connected to said movable handle means whereby upon movement of said handle means, both of said toggle means are straightened and said ram means is moved towards said second jaw.

* * * * *